US007047897B2

(12) United States Patent
Eloranta et al.

(10) Patent No.: US 7,047,897 B2
(45) Date of Patent: May 23, 2006

(54) SYSTEM AND METHOD IN WATER-CRAFT

(75) Inventors: Sauli Eloranta, Vahto (FI); Tuomas Routa, Espoo (FI); Jarmo Wacker, Kaarina (FI)

(73) Assignee: Kvaerner Masa-Yards Oy, Helsinki (FI)

( * ) Notice: Subject to any disclaimer, the term of this patent is extended or adjusted under 35 U.S.C. 154(b) by 0 days.

(21) Appl. No.: 10/509,003

(22) PCT Filed: Mar. 20, 2003

(86) PCT No.: PCT/FI03/00217

§ 371 (c)(1),
(2), (4) Date: Dec. 2, 2004

(87) PCT Pub. No.: WO03/080427

PCT Pub. Date: Oct. 2, 2003

(65) Prior Publication Data

US 2005/0155538 A1 Jul. 21, 2005

(30) Foreign Application Priority Data

Mar. 27, 2002 (FI) ..... 20020588

(51) Int. Cl.
*B63B 3/00* (2006.01)

(52) U.S. Cl. ..... 114/65 R; 114/71

(58) Field of Classification Search ..... 114/65 R, 114/71

See application file for complete search history.

(56) References Cited

U.S. PATENT DOCUMENTS 2,499,498 A * 3/1950 Hammond Jr. ..... 52/67
3,514,910 A * 6/1970 Comm ..... 52/79.11
3,541,744 A 11/1970 Maxwell
3,638,380 A 2/1972 Perri
4,779,552 A * 10/1988 Harsia et al. ..... 114/65 R
4,838,190 A * 6/1989 Levander ..... 114/56.1
5,335,614 A * 8/1994 Klaus ..... 114/71
5,887,405 A * 3/1999 Carranza-Aubry ..... 52/745.1

FOREIGN PATENT DOCUMENTS

DE 40 24 497 2/1992
GB 2 110 603 6/1983

* cited by examiner

*Primary Examiner*—Stephen Avila
(74) *Attorney, Agent, or Firm*—Smith-Hill and Bedell

(57) ABSTRACT

The present invention relates to a system in a watercraft or a section thereof or in another structure or a section thereof for providing furnishings at least partially, which system comprises a number of prefabricated room units and a watercraft or a section thereof or another structure or a section thereof, and which system comprises one or several room units to be inserted into the watercraft or a section thereof or other structure or a section thereof, and which system comprises room units, the exterior side portion of which forms a part of the outboard of the watercraft or a section thereof or other structure or a section thereof and/or the interior side portion forms a part of the open inner section of the watercraft or a section thereof or other structure or a section thereof. Moreover, the invention relates to a method for providing furnishings at least partially in the system according to the claims, which system comprises a watercraft or a section thereof or another structure or a section thereof and at least one prefabricated room unit, according to which method at least one room unit is inserted into the watercraft or a section thereof or another structure or a section thereof and moved on the watercraft or a section thereof or other structure or a section thereof into its predetermined position.

19 Claims, 6 Drawing Sheets

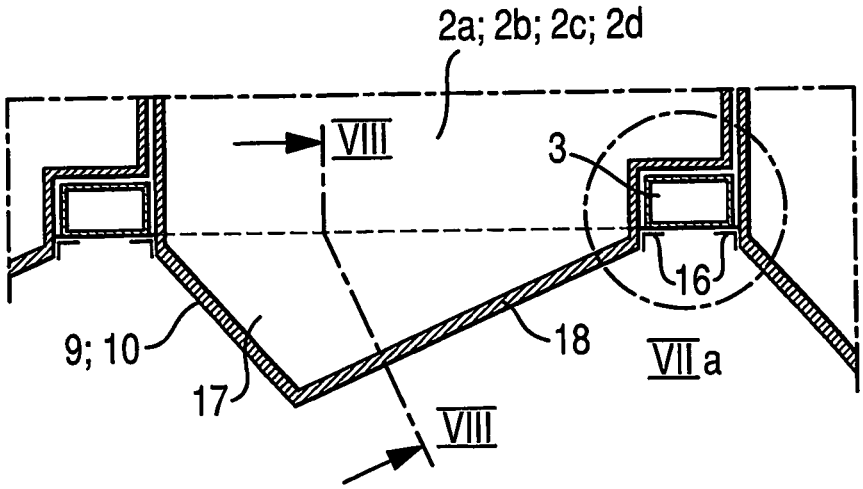
Fig. 7
Fig. 7 a
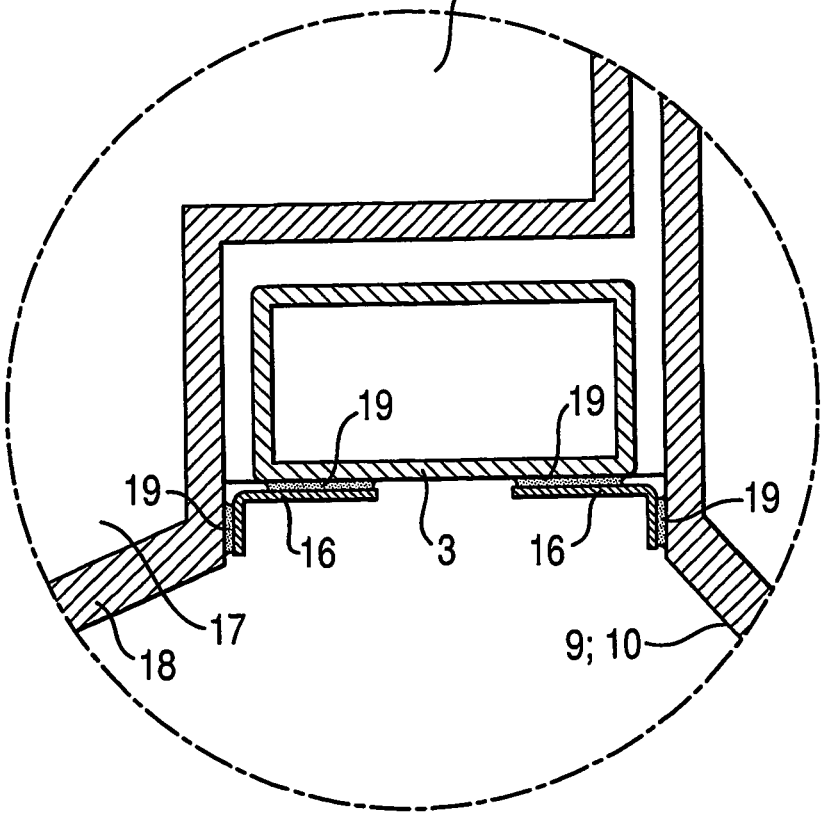

SYSTEM AND METHOD IN WATER-CRAFT

This is a national stage application filed under 35 USC 371 based on International Application No. PCT/FI2003/00217 filed Mar. 20, 2003, and claims priority under 35 USC 119 of Finnish Patent Application No. 20020588 filed Mar. 27, 2002.

The present relates to a system in a water-craft for providing furnishings at least partially, which system comprises a number of prefabricated room units and a water-craft or a section thereof.

The invention also relates to a method for providing furnishings at least partially, which method comprises a water-craft or a section thereof and at least one prefabricated room unit.

It is known from prior art to have systems for arranging room units in a water-craft or another structure so that a prefabricated room unit is brought into the water-craft or other structure, the outboards of which are constructed prior to bringing the room unit into the water-craft/other structure. It is also known to insert a room unit into a water-craft or another structure, which has in advance been provided with at least a structural outboard and generally also a window and insulation for the outboard. Such a system is disclosed in U.S. Pat. No. 6,016,636, where prefabricated cabin modules are brought onto the deck by means of a crane, approximately into their final positions.

It is also known from prior art to insert prefabricated room units into a water-craft/another structure through specific temporarily arranged openings and transfer them into their final positions by means of special transfer devices. Such systems are disclosed for instance in DE U.S. Pat. No. 4,024,497 and in U.S. Pat. No. 4,528,928. Various transfer systems and structures for cabins are disclosed e.g. in U.S. Pat. No. 6,260,496.

Furthermore, it is known to insert a cabin provided with a balcony into the ship so that the balcony wall is constructed aboard the ship prior to installing he cabin or after the installation, and that the balcony is secured to the ship's hull either before bringing the cabin into the ship or after that.

Significant disadvantages are, however, associated with the prior art. For instance, the transfer of cabins aboard the ship is time-consuming and the arrangement of temporary openings takes time and leaves marks on the final cladding of the ship. Moreover, the transfer of cabins on the ship may have an impact on the arrangement of stanchions or give cause for relocation or removing of the stanchions during the construction period. In all the above-discussed cases the cladding of the ship requires several man-hours of labour and the working conditions aboard are difficult, whereby the construction time of the ship may be extended.

An object of the present invention is to eliminate the disadvantages of the prior art and provide an entirely new kind of an arrangement.

The invention is based on the idea that one or several room units are arranged to be inserted into a water-craft or a section thereof, and that the system comprises room units, the exterior side portion of which forms a part of the outboard of the water-craft or a section thereof and/or the interior side portion forms a part of the open inner section of the water-craft or a section thereof.

The purpose of the present invention is to provide a prefabricated room unit which comprises an exterior side portion or an interior aide portion forming a part of the structural external or internal surface, respectively, of a water-craft or a section thereof. By this arrangement the room unit's window, window wall, balcony, balcony doors etc. can be constructed in workshops ashore and transported and lifted as one unit onto the water-craft or a section thereof, whereby the work carried out aboard the water-craft or a section thereof is diminished, the quality is improved and it is possible to shorten the construction time.

Alternatively, one or several room units are arranged to be inserted into a water-craft or a section thereof, which arrangement comprises room units, the exterior side portion and/or the interior side portion of which is open when being transferred into the water-craft or a section thereof, and the actual board section is attached afterwards to the water-craft or a section thereof. The attachment, sealing and other similar operations may also in this case be carried out via the outboard or the open inner section of the water-craft.

This purpose may according to the invention be achieved by applying a method for providing furnishings in a water-craft or a section thereof comprising a water-craft or a section thereof and at least one prefabricated room unit so that at least one room unit is inserted into the water-craft or a section thereof and moved aboard the water-craft or a section thereof into a predetermined location.

According to a preferred embodiment of the system according to the invention in a water-craft or a section thereof for providing furnishings the system comprises a number of prefabricated room units and a water-craft or a section thereof so that one or several room units are arranged to be inserted into the water-craft or a section thereof, and the system comprises room units, the exterior side portion of which forms a part of the outboard of the water-craft or a section thereof and/or the interior side portion forms a part of the open inner section of the water-craft or a section thereof. A room unit according to the system is composed of one or several cabins, rooms or similar units and the exterior side portion and/or the interior side portion consists of a window and/or a wall and/or a balcony. The section of the water-craft may refer e.g. to a compartment of a water-craft, whereby the system may be applied also in case the water-craft is composed of compartments. Thus the water-craft may be furnished already at the so-called compartment assembly stage by utilizing the above-described method, or alternatively it may be furnished, when the water-craft comprises several compartments, or is as one element irrespective of whether the water-craft is composed of compartments or not.

According to a second preferable embodiment of the invention the board of a water-craft's hull or a section thereof is substantially open and the overlying decks are supported by a supporting structure/structures, which is/are at the installation stage of the cabins located between every second room unit or spaced by a distance longer than this. The open board may in this context refer even merely to the so-called skeleton structure of a water-craft or a section thereof with mere steel stanchions and steel beams. Accordingly, the supporting structure may comprise a stanchion, a frame structure or other similar structure, and the distance between the stanchions may be even longer than mentioned above. Then the board section of the water-craft or a section thereof is installed after the room unit/units has/have been moved into the water-craft.

In both above-described systems the width of the opening arranged in the board of a water-craft or a section thereof is smaller than the total width of two or several room units, when the room units are being inserted into the water-craft. Then the sealing of the room unit/units is at least partially carried out by connecting the exterior side portion or the interior side portion directly to another exterior side portion or an interior side portion by means of separate cover strips, or by another sealing method, without the side portion being sealed to the bull of the water-craft or a section thereof. In addition, the side portion includes a floor and/or a ceiling portion to be installed separately and attached to the hull of the water-craft or a section thereof.

According to a preferred embodiment of the method in accordance with the present invention is provided a method for applying the system for providing furnishings at least partially in the system according to the claims discussed in the foregoing, which system comprises a water-craft or a section thereof and at least one prefabricated room unit so that at least one room unit is inserted into the water-craft or a section thereof, and moved on the water-craft or a section thereof into a predetermined location. After this, next room units are brought in one or several units at the time through an opening arranged in the board of the water-craft or a section thereof, or through the end thereof, which room units are moved into predetermined locations and after the room unit/units has/have reached its/their final position/-s the exterior side portion thereof is disposed and/or attached and/or sealed to the board, and/or the interior side portion thereof is disposed and/or attached and/or sealed to the board. If the room unit is not, however, provided with an exterior side portion and/or an interior side portion in advance, an alternative method is applied, according to which a separate side portion is disposed and/or attached and/or sealed to the room unit or to the board.

In both discussed cases the room unit may comprise one or more cabins, rooms or the like and/or the side portion may comprise one or more windows and/or walls and/or balconies. In addition, the room unit is in the transverse direction of the water-craft or a section thereof brought in through the board of the water-craft or a section thereof without any substantial movement in the longitudinal direction of the water-craft or a section thereof, so that said movement is preferably smaller than the width of the room unit.

By the present invention considerable advantages are provided. Thus the installation time of structures of the water-craft will be shortened and simplified, whereby the overall costs of the water-craft are reduced considerably. Moreover, the system according to the invention provides more of so-called large outboard rooms aboard the water-craft, which rooms are more expensive for the customers than normal rooms. Thus the owner of the water-craft will also get a higher price for the present arrangement and the customer will stay a longer period in the room unit, as the comfort therein has improved.

The room unit according to the invention is lifted aboard the water-craft or a section thereof so that inboard cabins and cabins provided with an exterior side portion are inserted directly onto the correct deck or to the correct floor and into the correct position through an opening, which is as wide as about two cabins, rooms or the like. Through the opening are inserted the inboard and outboard cabins facing the opening in the longitudinal direction of the water-craft, the first one of which cabins is inserted through the opening in the transverse direction of the ship approximately into its final position, after which the cabin is moved in the longitudinal direction of the ship behind a stanchion or a similar structure. The second cabin is moved directly into its position substantially without any movement in the longitudinal direction of the ship. Thus all the cabins of the ship may be prefabricated, as the first outboard cabin will utilize the space located behind the stanchion.

By supporting the water-craft's deck by the outboard of the water-craft at every second cabin the cabins provided with an exterior or interior side portion may be inserted through openings of final size, the width of the openings being about the same as the total width of two cabins. The ship's inboard cabins may be inserted into the ship through the same opening without arranging any specific temporary openings. The advantage achieved by this is that the transfer distance on the ship is very short, temporary openings or removals of stanchions are not necessary and the construction time of the ship may be shortened. A prefabricated cabin provided with a side portion according to the invention may be brought aboard the ship by lifting the cabin directly through the board almost directly to its final position in the longitudinal direction of the ship. Stanchions may be installed between the cabins, if required, after the cabins have been lifted onto the ship.

The side portion according to the invention is attached to the cabins before it is lifted onto the ship so that both the cabin and the side portion are lifted simultaneously. The side portion may consist for instance of 1. a window, whereby the cabin is provided with an end wall, to which the ship's window facing outwards or inwards as well as the cladding of the end wall are attached. Thus the water-craft is provided with an opening for window surrounded by the ship structure. The cabin is inserted in the ship in a conventional manner.
2. an end wall, whereby the cabin is provided with an end wall located on the outer surface of the ship. In this case the ship is provided with an opening substantially of the size of the cabin end or the two cabin ends. The cabin may be transferred to its position in a conventional way or directly through the opening in the outboard. The end wall may preferably extend beyond the boards of the ship, whereby a separate, to the ship structures attached floor or ceiling is arranged underneath and/or above the wall, which floor or ceiling may constitute an integral part of the cabin structure. Thus the cabin gets more floor area and the view from the cabin is wider. Similar advantages are achieved also by carrying the cabin in through the open inner section, i.e. in the case of a so-called promenade cabin.
3. a balcony, whereby the cabin is provided with a balcony module installed in advance, when being brought into the water-craft. The cabin may be provided with a balcony door and a window or such may be installed later. The cabin may be located in position in a conventional way or directly through an opening in the board.

In the following the invention is described with reference to the attached drawings, in which FIG. 1 shows hew the furnishings are provided as a section view of a water-craft seen from above;

FIG. 7 shows an attachment and/or a sealing arrangement seen from above;

FIG. 7*a* shows an enlarged view of detail VII indicated in FIG. 7; and

Figure 8:
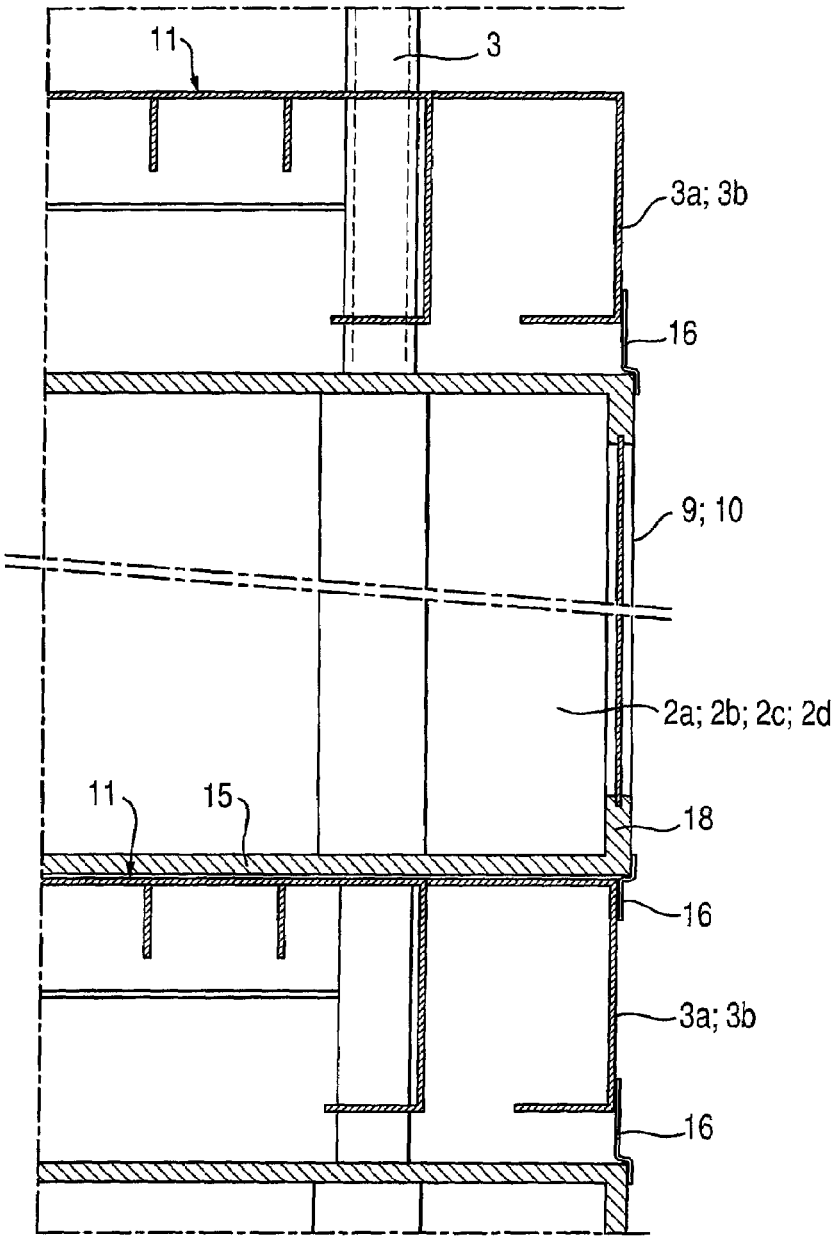

FIG. 8 shows a sectional view VIII—VIII indicated in FIG. 7.

Figure 1:
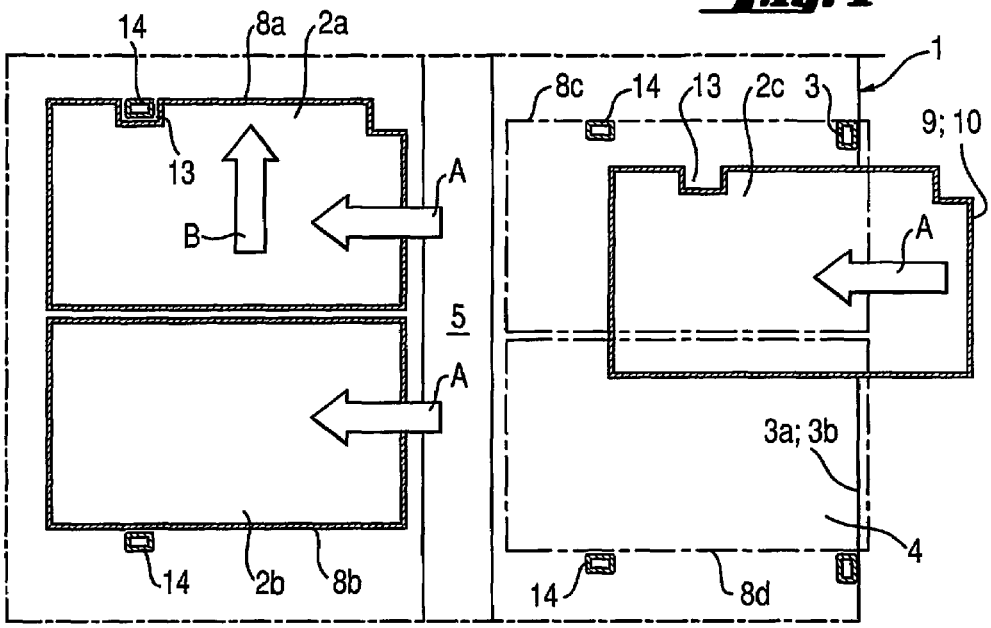

The water-craft comprises a ship 1 according to the embodiment in FIG. 1. The figure shows also room units 2*a*, 2*b*, 2*c* and 2*d*, which in this case are preferably cabins. The cabins 2*a*, 2*b*, 2*c*, 2*d* etc. are prefabricated and provided with an exterior side portion 9 or an interior side portion 10. According to the figure cabin 2*a* is first inserted through an opening 4 in board 3*a*, 3*b* into the water-craft 1 as shown by arrow A, i.e. in the transverse direction of the water-craft. In order to make the cabin 2*a* reach its predetermined position 8*a* it is also moved as shown by arrow B in the longitudinal direction of the water-craft 1. The cabin has also been provided with a formed part 13 in advance, into which part stanchion 14 fits. Next, cabin 2*b* is inserted through the opening 4 and moved to its predetermined position 8*b* as shown by arrow A. After this, cabin 2*c* is moved to its position 8*c*, first as shown by arrow A through the opening 4 in the hoard 3*a*, 3*b*. An alleyway portion 5 is in this case left between the cabins.

Figure 2:
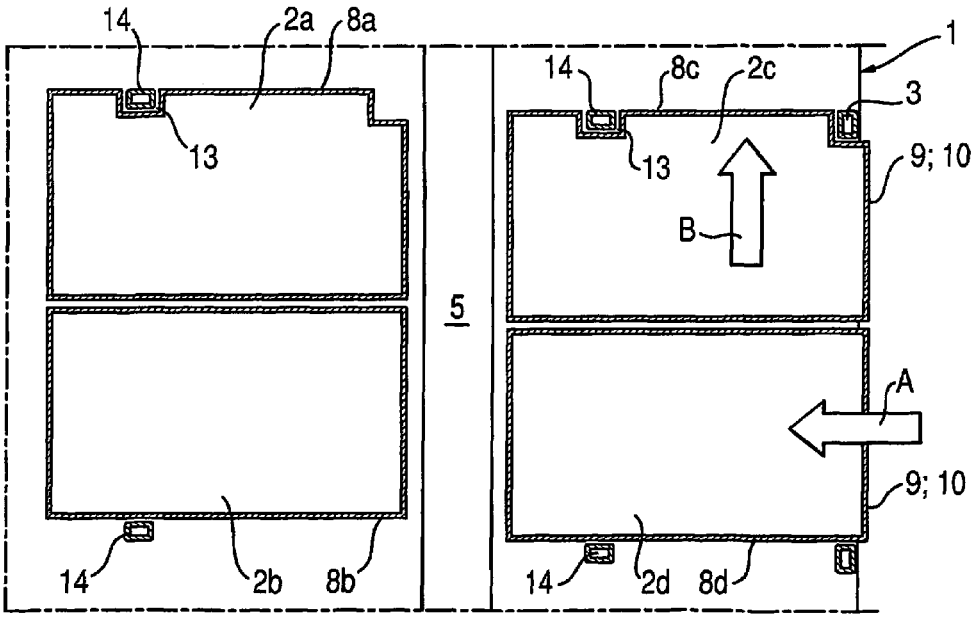
FIG. 2 shows the following stage of providing the furnishings as a section view of a water-craft seen from above.

FIG. 2 shows a situation, where the cabins 2*a*, 2*b* and 2*c* are already in their final positions 8*a*, 8*b* and 8*c* and accordingly, the formed part 13 in cabin 2*c* faces the stanchion 14 after the cabin 2*c* has been moved in the direction of arrow B in the longitudinal direction of the water-craft. Finally, cabin 2*d* is inserted in the direction of arrow A into its final position 8*d*, whereby the exterior side portions 9, 10 form in this case the outboard of the water-craft. Similarly, they could also form the interior wall section aboard the water-craft, if the cabins had been moved for instance from the so-called promenade located in the middle of the water-craft. Alternatively, cabins 2*a* and 2*b* could also form the interior wall section of the water-craft not shown in the figure, even if they were lifted aboard through the opening in the board 3*a*, 3*b*. Neither need the cabins have the shapes shown in the figure, but they could all have for instance the same shape irrespective of their positions in the water-craft or whether the formed part 13 is needed at all, in case there is no stanchion located in the cabin's predetermined position.

Figure 3:
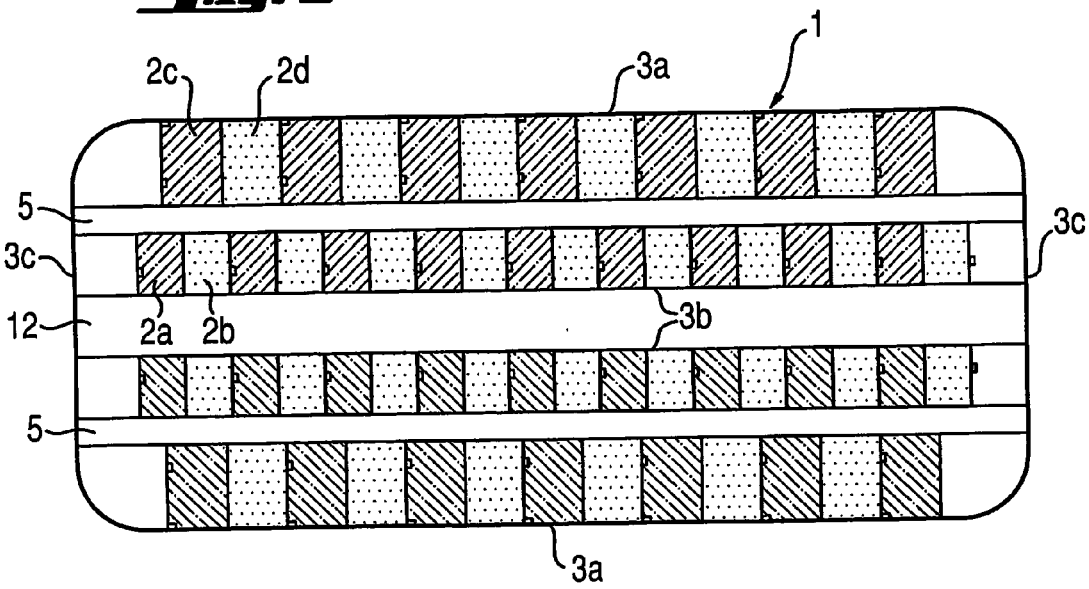
FIG. 3 shows a section view of a water-craft seen from above.

This could be better explained with reference to FIG. 3, where the reference number 1 indicates a water-craft and the numerals 2*a*, 2*b*, 2*c*, and 2*d* refer to the room units therein. In this application the numeral 3*a* represents the outboard of the water-craft 1 and the numeral 3*b* the interior board surrounding the open inner section 12 of the water-craft. In this case the inner section consists of a so-called footway, i.e. a promenade, of the ship. The interior board 3*b* consists of cabins 2*a*, 2*b* etc., which in this embodiment have been moved onto the ship through the outboard 3*a*, i.e. as shown in FIGS. 1 and 2. Alternatively, they could have been taken in even from the promenade's 12 side, i.e. via the interior board 3*b*, and that being the case the cabins 2*c* and 2*d*, for instance, have been inserted first and finally the cabins 2*a* and 2*b*. It is, of course, possible that the cabins have been moved onto the ship both via the outboard 3*a* and the interior board 3*b* and that there are more than four cabins in the transverse direction of the water-craft, advantageously for instance eight, whereby also more alleyways 5 than the two shown in FIG. 3 are provided. Also the ends 3*c* of the water-craft, its section or compartment, are marked in the figure, through which ends the cabins may thus alternatively be inserted into the water-craft.

Figure 4:
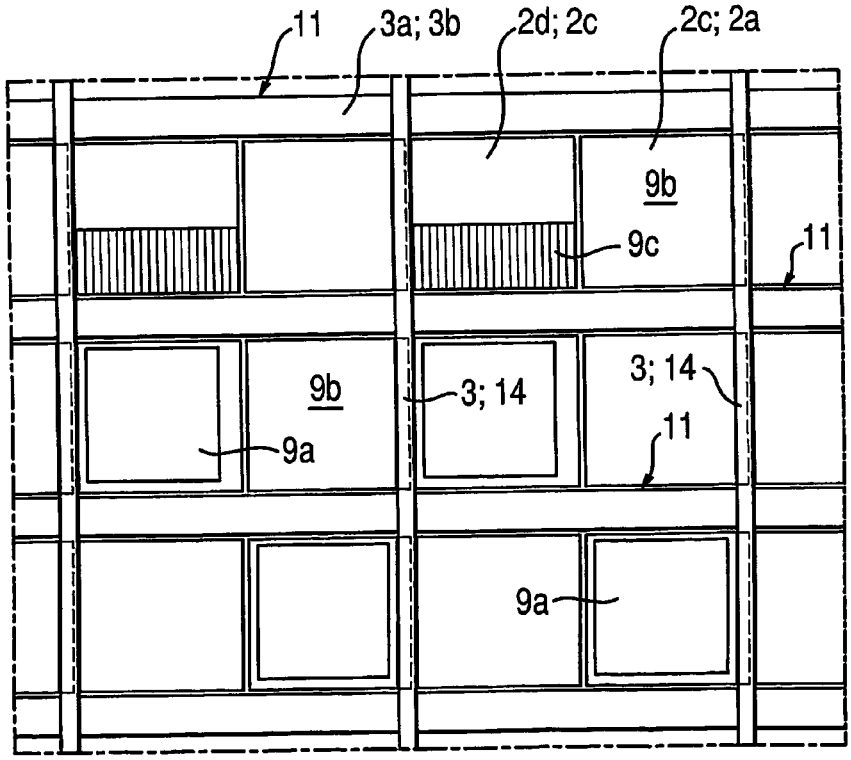
FIG. 4 shows a side view of a water-craft seen from the side.

FIG. 4 shows a side view of a water-craft whereby cabins 2*c* and 2*d* are visible, if the water-craft according to FIG. 3 is looked from outside, and similarly, cabins 2*a* and 2*b* are visible, if the water-craft is looked from the side of the open interior, i.e. from the promenade. Furthermore, if looked from outside, the board 3*a* and possibly the stanchions 14 are visible, and if looked from inside, the interior board 3*b* is visible and possibly, due to structural engineering conceptions, also the stanchions 14. In the interior the side portions may consist e.g. of merely a window 9*a* or a wall 9*b* and the outboard sections either of a balcony 9*c* or merely a window 9*a*.

Figure 5:
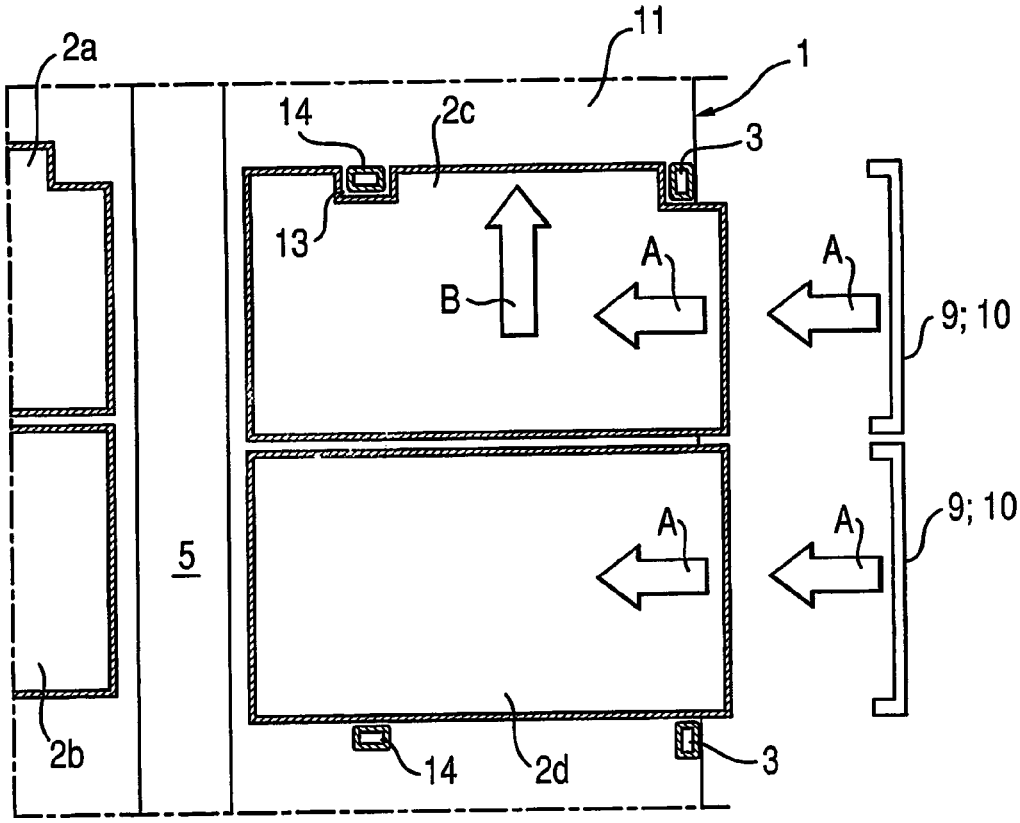
FIG. 5 shows how the furnishings are provided according to a second embodiment of the invention as a section view of a water-craft seen from above.

FIG. 5 shows an alternative furnishing concept, where the cabins 2*a*, 2*b*, 2*c* and 2*d* are brought into a water-craft or another structure in accordance with FIGS. 1 and 2. FIG. 5 also shows a stanchion 14, which fits into the formed part 13 when room unit 2*c* is moved as shown by arrow B, as well as a steel construction 3. The exception in this version is that the room units are not provided with a side portion 9, 10 in advance, but the side portion is not disposed, attached and/or sealed until the room units have been moved onto the water-craft in accordance with arrow A. The side portion may also be attached prior to the installation of the room units, whereby the room units are brought into the water-craft in a conventional way.

Figure 6:
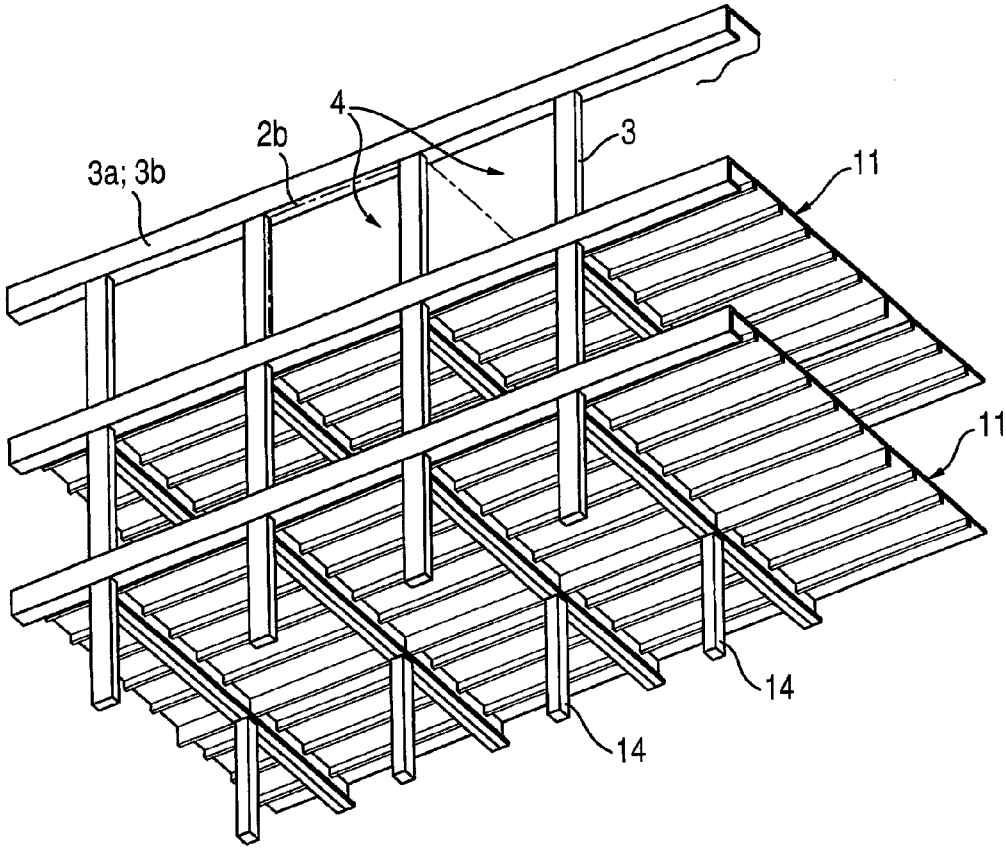
FIG. 6 shows a simplified view of the situation of FIG. 5 in perspective.

FIG. 6 shows the situation of FIG. 5 simplified and seen obliquely from below at the stage, when cabin unit 2*b* is moved to rest upon the steel construction 3 of the water-craft. The steel construction consists of vertical and horizontal stanchions 14 and in this case also of a deck construction 11. In addition, the figure shows the board 3*a* and the opening 4, through which the cabin units are inserted into the watercraft.

FIG. 7 shows a sealing arrangement, according to which the room units 2*a*, 2*b*, 2*c*, 2*d* etc. are sealed to the hull 3 of the water-craft by means of a profile 16 and a seal 19, of which arrangement detail VII is extracted and shown in FIG. 7*a*. Naturally, the arrangement also includes fixing means, which are not shown in the figure. Also the side portion 9, 10 is clearly shown in the figure, which portion may also have another than a right-angled shape, for instance a so-called oriel. In this case the side portion includes a floor and/or ceiling portion to be mounted separately and indicated by the reference number 17.

FIG. 8 shows a section view A—A of FIG. 7. In this figure the lower beam 15 of the room unit is preferably attached by welding to the deck 11 of the water-craft by utilizing e.g. shims. The frame 18 of the side portions 9, 10 is sealed to the board 3*a*, 3*b* of the water-craft by a profile 16, which is secured to the side portion by fixing means, e.g. by a screw or the like, either before inserting the room unit into the watercraft or after that. The profile is sealed to the side portion e.g. by a rubber seal, as shown in FIG. 7, which seal is squeezed by tightening the fixing means. The profile is tightened to the board by fastenings means, e.g. by a sealing compound or by a stud reaching through the profile into the board. Similar fastening may be used when the side portion is attached e.g. to a stanchion 3, which carries the outboard, or between two adjacent side portions so that the profile is attached by a screw to a first side portion and then by a stud to a second side portion.

It is apparent to a person skilled in the art that the invention is not limited to the above-described embodiments, where the invention is described by way of example, but various applications of the invention are conceivable in the scope of the inventive conception defined by the appended claims.

The invention claimed is:

1. A watercraft comprising a board formed with an opening of width W, a deck construction provided with first and second support structures spaced longitudinally of the board at a distance D, and a plurality of prefabricated room units to be installed on the deck construction between the first and second support structures, wherein the width W is larger than the width of each of said plurality of room units and is smaller than the total width of the plurality of room units, and D is not greater than the total width of said plurality of room units, whereby a first of said room units can be installed in the watercraft through the opening into a preliminary position on the deck construction and can be moved longitudinally of the board to a predetermined final position substantially abutting the first support structure, and a second of said plurality of room units can be installed in the watercraft through the opening into a predetermined position on the deck construction, adjacent the first room unit, and in said predetermined position of each room unit an exterior side portion of the room unit forms a part of the outboard of the watercraft and/or an interior side portion of the room unit forms a part of an interior board surrounding an open inner section of the watercraft.

2. A watercraft according to claim 1, wherein the room unit comprises one or more cabins, rooms or similar units.

3. A watercraft according to claim 1, wherein the exterior side portion and/or the interior aide portion consists of a window, a wall and/or a balcony.

4. A watercraft according to claim 1, wherein the side portion includes a floor and/or a ceiling portion to be installed separately.

5. A watercraft according to claim 1, wherein the first room unit is formed with a channel, and when the first room unit is in its predetermined final position the channel receives the first support structure.

6. A watercraft according to claim 5, wherein the plurality of prefabricated room units comprises two room units and the predetermined position of the second room unit is substantially abutting the second support structure.

7. A watercraft comprising a board formed with an opening of width W, a deck construction provided with first and second support structures spaced longitudinally of the board at a distance D, and a plurality of prefabricated room units installed on the deck construction between the first and second support structures, wherein the width W is larger than the width of each of said plurality of room units and is smaller than the total width of the plurality of room units, and D is not greater than the total width of said plurality of room units, a first of said room units is installed at a predetermined position on the deck construction substantially abutting the first support structure, and a second D said plurality of room units is installed in the watercraft at a predetermined position adjacent the first room unit, without an intervening vertical support structure between the first and second room units, and in said predetermined position of each room unit an exterior side portion of the room unit forms a part of the outboard of the watercraft and/or an interior side portion of the room unit forms a part of an interior board surrounding an open inner section of the watercraft.

8. A watercraft according to claim 7, wherein the room unit comprises one or more cabins, rooms or similar units.

9. A watercraft according to claim 7, wherein the exterior side portion and/or the interior side portion consists of a window, a wall and/or a balcony.

10. A watercraft according to claim 9, wherein the side portion includes a floor and/or a ceiling portion to be installed separately.

11. A watercraft according to claim 7, wherein the first room unit is formed with a channel, and when the first room unit is in its predetermined final position the channel receives the first support structure.

12. A watercraft according to claim 11, wherein the plurality of prefabricated room unite comprises two room units and the predetermined position of the second room unit is substantially abutting the second support structure.

13. A watercraft according to claim 7, wherein the plurality of prefabricated room units comprises two room units and in said predetermined position of the first and second room units an interior side portion of the room unit forms a part of an interior board surrounding an open inner section of the watercraft, and the watercraft further comprises third and fourth room units in predetermined respective positions on the deck construction adjacent the first and second room units respectively, transversely of the board, and an exterior side portion of each of the third and fourth room units forms a part of the outboard of the watercraft.

14. A method for providing furnishings in a watercraft comprising a board formed with an opening of width W, a deck construction provided with first and second support structures spaced longitudinally of the board at a distance D, and a plurality of prefabricated room units, wherein the width W is larger than the width of each of said plurality of room units and is smaller than the total width of the plurality of room units, and D is not greater than the total width of said plurality of room units, said method comprising:

installing a first of said room units in the watercraft through the opening into a preliminary position on the deck construction, moving the first room unit longitudinally of the board to a predetermined final position substantially abutting the first support structure, installing a second of said plurality of room units in the watercraft through the opening into a predetermined position on the deck construction, adjacent the first room unit, and wherein in said predetermined position of each room unit an exterior side portion of the room unit forms a part of the outboard of the watercraft and/or an interior side portion of the room unit forms a part of an interior board surrounding an open inner section of the watercraft.

15. A method according to claim 14, comprising installing a separate side portion of a room unit after the room unit has been moved into the watercraft.

16. A method according to claim 14, comprising disposing, attaching and/or sealing the exterior side portion to the outboard and/or disposing, attaching and/or sealing the interior side portion to the interior board after the room unit has reached the predetermined position.

17. A method according to claim 14, comprising disposing, attaching and/or sealing a separate side portion to the room unit or to the board.

18. A method according to claim 14, wherein each room unit comprises one or more cabins, rooms or similar units and/or the side portion comprises one or more windows, walls and/or balconies.

19. A method according to claim 14, comprising moving the first room unit aboard in the transverse direction (A) of the watercraft through the board of the watercraft without any substantial movement in the longitudinal direction (B) of the watercraft, so that the movement in the longitudinal direction (B) is preferably smaller than the width of the room unit.

* * * * *